US006648548B2

(12) United States Patent
Kelsay, III

(10) Patent No.: US 6,648,548 B2
(45) **Date of Patent: *Nov. 18, 2003**

(54) BLADE FOR MOTORIZED TROWEL

(75) Inventor: Gordon M. Kelsay, III, Glasgow, KY (US)

(73) Assignee: Smith and Kelsay Mfg., Glasgow, KY (US)

( * ) Notice: Subject to any disclaimer, the term of this patent is extended or adjusted under 35 U.S.C. 154(b) by 97 days.

This patent is subject to a terminal disclaimer.

(21) Appl. No.: 10/008,387

(22) Filed: Dec. 7, 2001

(65) Prior Publication Data

US 2002/0119005 A1 Aug. 29, 2002

Related U.S. Application Data

(63) Continuation-in-part of application No. 09/793,932, filed on Feb. 27, 2001, now Pat. No. 6,419,419.

(51) Int. Cl.[7] ..... E01C 19/22
(52) U.S. Cl. ..... 404/112
(58) Field of Search ..... 404/112, 118; 451/353; 15/235.4

(56) References Cited

U.S. PATENT DOCUMENTS

| | | | | |
|---|---|---|---|---|
| 162,355 A | | 4/1875 | Disston | |
| 938,070 A | | 10/1909 | Neerup | |
| 2,108,470 A | | 2/1938 | Boulton | |
| 2,198,929 A | | 4/1940 | Whiteman | |
| 2,556,983 A | | 6/1951 | Root | |
| 2,662,454 A | | 12/1953 | Whiteman | |
| 2,689,507 A | * | 9/1954 | McCrery | 404/112 |
| 2,865,269 A | | 12/1958 | McMillan | |
| 2,888,863 A | | 6/1959 | Eisenbeis | |
| 3,375,766 A | | 4/1968 | Zochil | |
| 3,683,761 A | | 8/1972 | Babic | |
| 3,916,816 A | * | 11/1975 | Fitch | 116/63 P |
| 4,073,482 A | * | 2/1978 | Seegmiller et al. | 256/13.1 |
| 4,388,017 A | | 6/1983 | Morrison | |
| 4,556,339 A | | 12/1985 | Morrison | |
| 4,688,766 A | * | 8/1987 | Zucker | 256/13.1 |
| 4,859,115 A | | 8/1989 | Morrison | |
| 5,906,455 A | | 5/1999 | McLaughlin | |
| 6,264,397 B1 | * | 7/2001 | Majewski | 404/112 |
| 6,419,419 B1 | * | 7/2002 | Kelsay, III | 404/112 |

FOREIGN PATENT DOCUMENTS

| | | |
|---|---|---|
| EP | 1 158 115 | 11/2001 |

* cited by examiner

*Primary Examiner*—Gary S. Hartmann
(74) *Attorney, Agent, or Firm*—Camoriano and Associates; Theresa Fritz Camoriano

(57) ABSTRACT

A trowel machine has replaceable blades. In a preferred embodiment, the blade can be replaced separately from the backing bar, and the same fasteners that secure the blade to the backing bar also secure to the trowel arm of the machine. In a preferred embodiment, the blade is deformed in the area of the mounting holes, providing an interlocking, clamping surface recessed from the working surface of the blade, so that there is retention of the blade on the trowel machine, even as the blade wears.

3 Claims, 10 Drawing Sheets

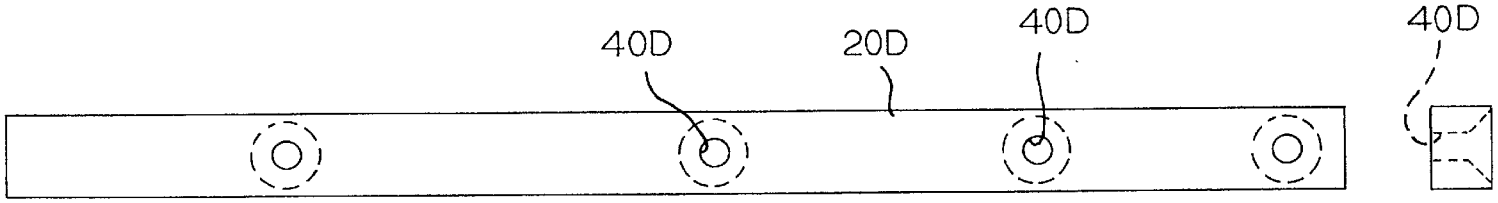
FIG. 15
FIG. 16
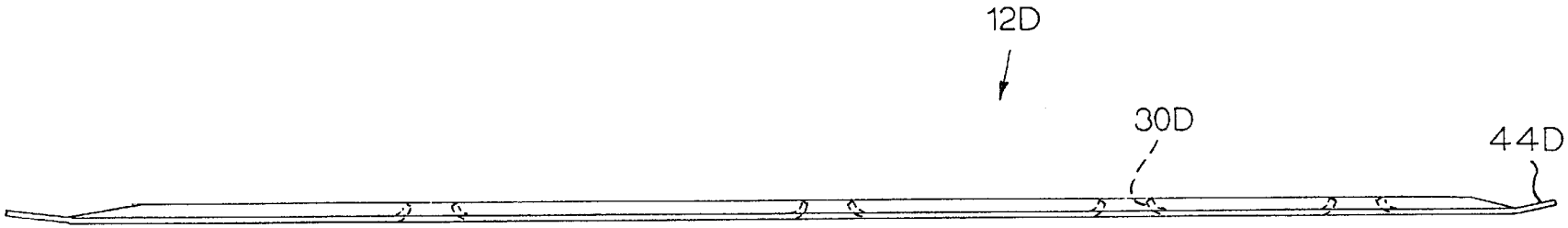
FIG. 17

BLADE FOR MOTORIZED TROWEL

BACKGROUND OF THE INVENTION

This application is a continuation-in-part of U.S. application Ser. No. 09/793,932, filed Feb. 27, 2001 now U.S. Pat No. 6,419,419. The present invention relates to motorized trowels for smoothing concrete, and, in particular, to a new trowel blade. In the prior art, each trowel blade is riveted onto a backing bar, which, in turn, is bolted onto an arm of the motorized trowel machine. There are problems with that arrangement. First, as the machine rotates the blades to smooth the concrete surface, the bottom surface of each blade wears, and the head of the rivet also wears. The head of the rivet is flush with the bottom of the trowel and contacts the blade only along the thickness of the blade, which is a very small area. As the blade and rivet wear, the blade can come loose from the machine, which is undesirable. Second, when the blade wears out (and these blades wear out frequently, approximately every two weeks for a machine that is in regular use), the entire blade, including the backing bar, must be thrown out in order to replace the blade, which is expensive.

SUMMARY OF THE INVENTION

The preferred embodiments of the present invention provide a more secure retention mechanism between the trowel blade and the backing bar and permit the trowel blade to be removed from its backing bar when the blade wears out and a new blade to be inserted in its place without having to replace the backing bar. Thus, as the blade wears out, it will not come loose from the machine, and replacing a worn blade is substantially less expensive and less wasteful of material than in the prior art.

BRIEF DESCRIPTION OF THE DRAWINGS

FIG. 15 is a plan view of the backing bar for the embodiment of FIG. 14;

FIG. 16 is an end view of the backing bar of FIG. 15;

FIG. 17 is a side view of the blade of FIG. 14A; and

DESCRIPTION OF THE PREFERRED EMBODIMENTS

Figure 1:
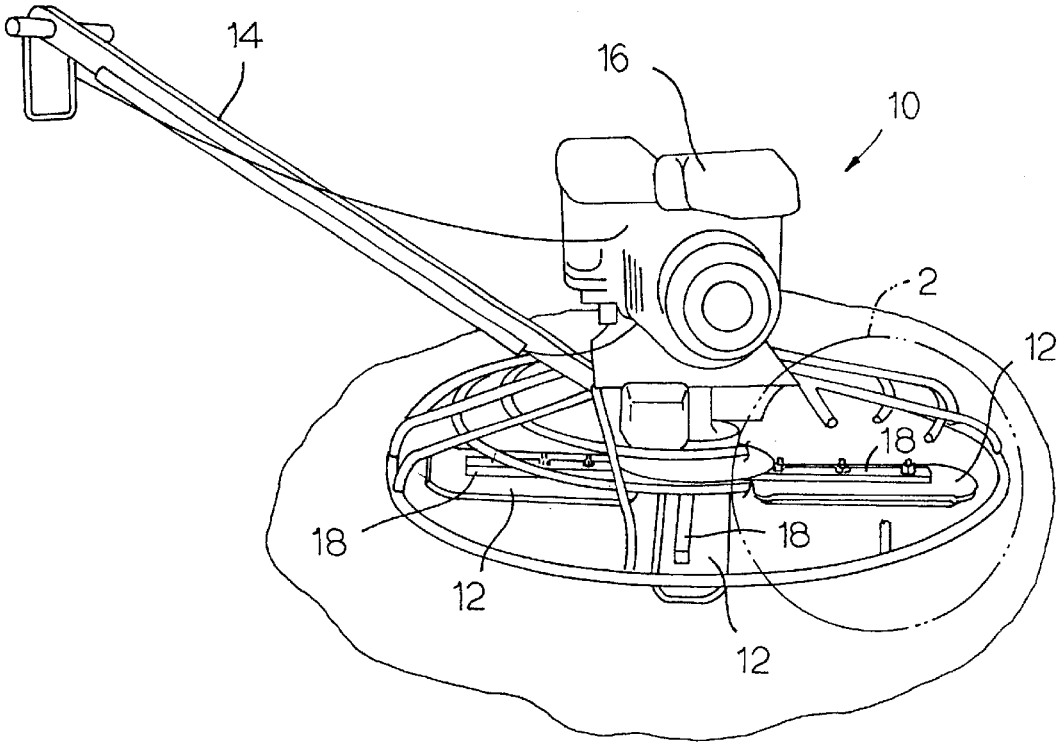
FIG. 1 shows a motorized trowel machine on which are mounted trowel blades made in accordance with the present invention.
Figure 2:
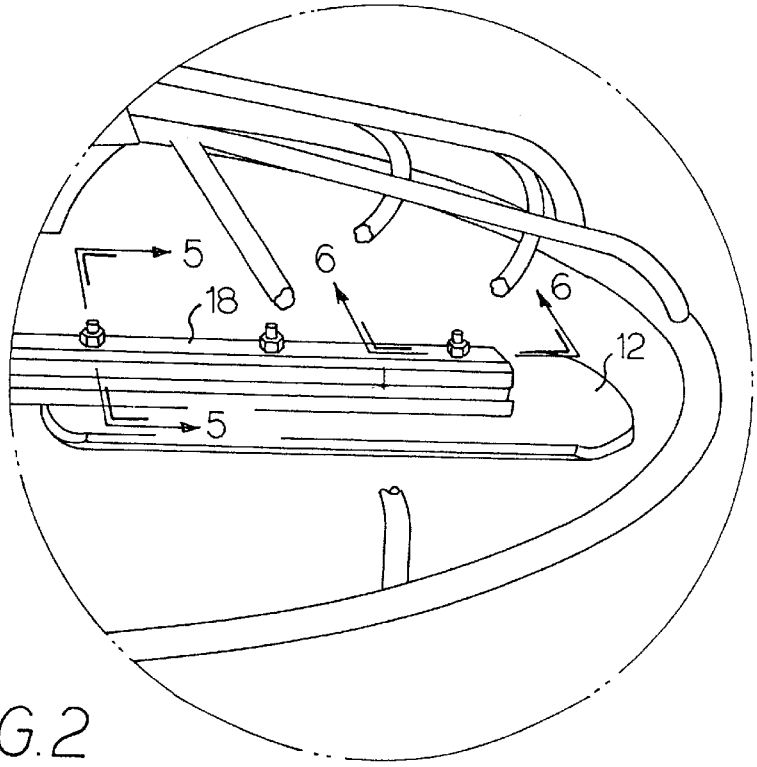
FIG. 2 is an enlarged view showing one of the blades of FIG. 1.

FIGS. 1 and 2 show a motorized trowel machine 10 on which are mounted trowel blades 12 made in accordance with the present invention. The machine 10 includes a handle 14, and a motor 16, which has an output shaft (not shown) on which are mounted radially-extending trowel arms 18.

Figure 4:
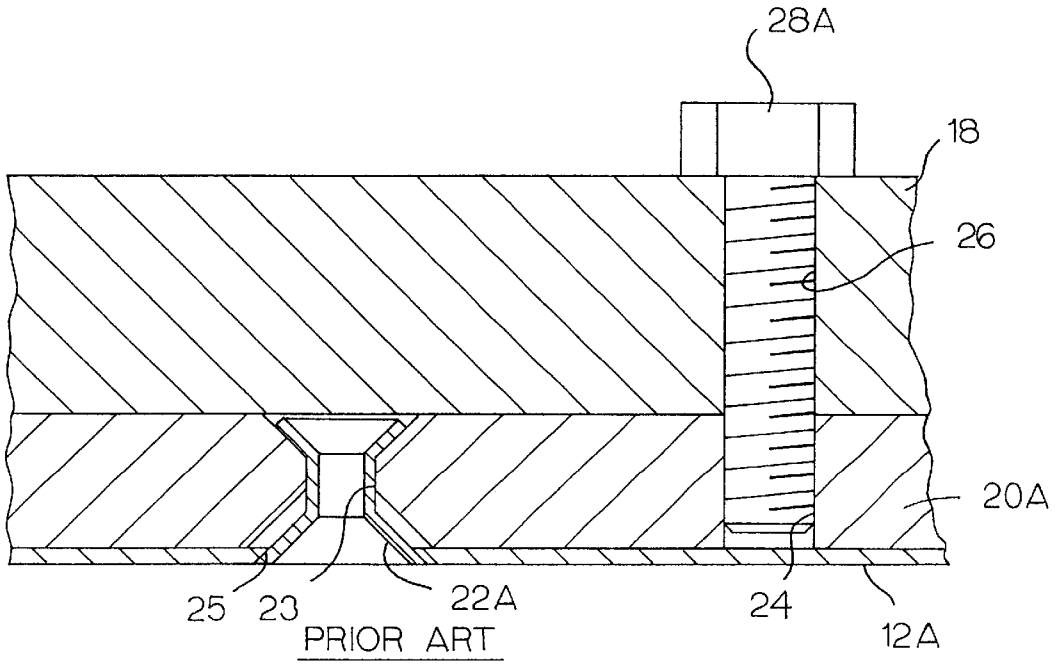
PRIOR ART FIG. 4
FIG. 4 is a sectional view of a prior art blade mounted on a machine of the type shown in FIG. 1 and taken along the same direction as FIG. 6.
Figure 3:
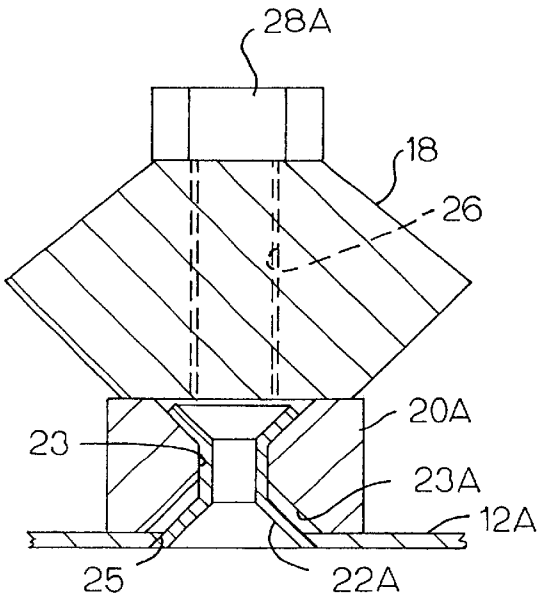
PRIOR ART FIG 3
FIG. 3 is a sectional view of a prior art blade mounted on a machine of the type shown in FIG. 1 and taken along the same direction as FIG. 5.
Figure 6:
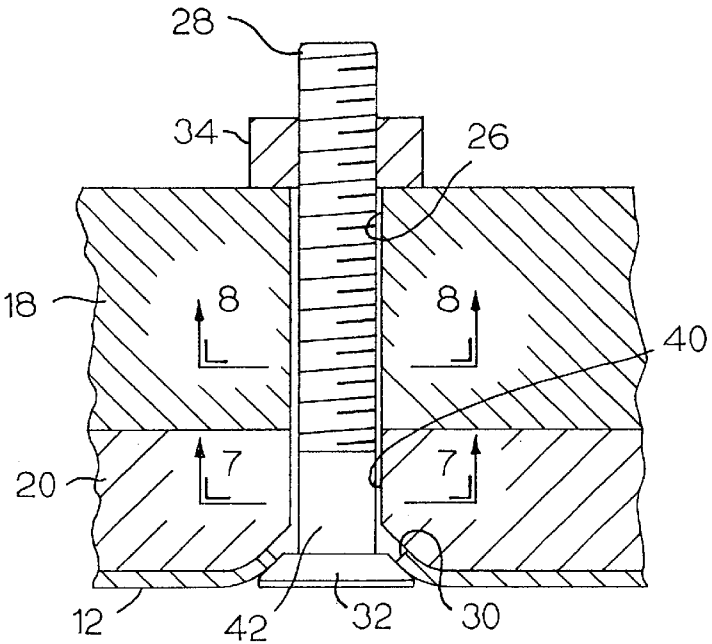
FIG. 6 is a view taken along the section 6—6 of FIG. 2.
Figure 8:
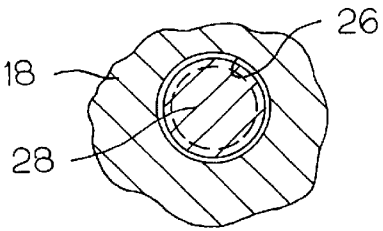
FIG. 8 is a view taken along the section 8—8 of FIG. 6.
Figure 5:
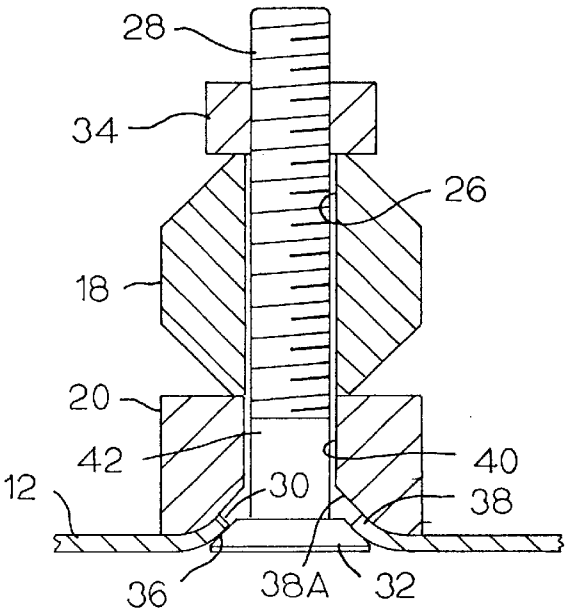
FIG. 5 is a view taken along the section 5—5 of FIG. 2.
Figure 7:
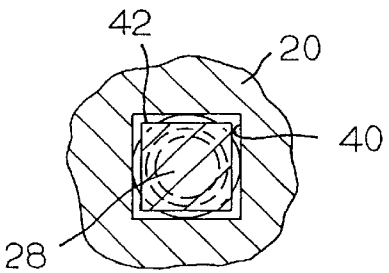
FIG. 7 is a view taken along the section 7—7 of FIG. 6.

FIGS. 3 and 4 show a prior art blade 12A mounted on a trowel arm 18 in the place of the blades 12 of FIGS. 1 and 2. In that prior art arrangement, the blade 12A is riveted onto a backing bar 20A by means of rivets 22A extending through holes 23 in the backing bar and holes 25 in the blade 12A. The top and bottom surfaces of the backing bar 20A define tapered indentations 23A around each hole 23, which allows the heads of the rivets 22A to be countersunk into the backing bar 20A. The thin-walled rivet head holds the blade 12A onto the backing bar 20A by contacting the edge of the flat sheet 12A at the hole 25, providing little contact surface. Also, all of the contact surface which retains the blade on the backing bar 20A is located at the normal working thickness of the flat blade, and, as the blade wears, the connection holding the blade onto the machine also wears. The thin-walled head of the rivet 22A also erodes as the blade erodes. There is an air gap between the rivet head and the indentation 23A in the bottom surface of the backing bar 20A, so the blade 12A is just hanging onto the rivet head along a very thin edge of the flat blade and is pressed against the flat bottom surface of the backing bar 20A.

The backing bar 20A has threaded holes 24, which are separated from the rivet holes 23, and which are aligned with holes 26 through the trowel arm 18. Bolts 28A extend downwardly from the top surface of the trowel arm 18, through the holes 26 in the trowel arm, and are threaded into the threaded holes 24 of the backing bar 20A to fasten the trowel blade 12A onto the trowel arm 18. The holes 25 in the trowel blade 12A are not aligned with these holes 24, 26 in the backing bar 20A and the trowel arm 18, respectively.

FIGS. 5–8 show the details of a preferred mounting arrangement made in accordance with the present invention for mounting the blades 12 on the trowel arms 18. This arrangement differs from the prior art arrangement of FIGS. 3 and 4 in several respects.

The bolts 28 which hold the blades 12 onto the trowel arms 18 extend not only through the trowel arm 18 and the backing bar 20, but also through holes 30 in the trowel blade 12, so the holes 30 in the trowel blade 12 are aligned with the holes 26 in the trowel arm 18. Instead of extending downwardly, as in the prior art, the bolts 28 extend upwardly, with the heads 32 of the bolts 28 in contact with the trowel blade 12, and nuts 34 are threaded onto the ends of the bolts 28 on top of the trowel arm 18. The result is that the same fastener 28 that holds the blade 12 onto the backing bar 20 also holds the blade 12 onto the trowel arm 18.

Figure 9:
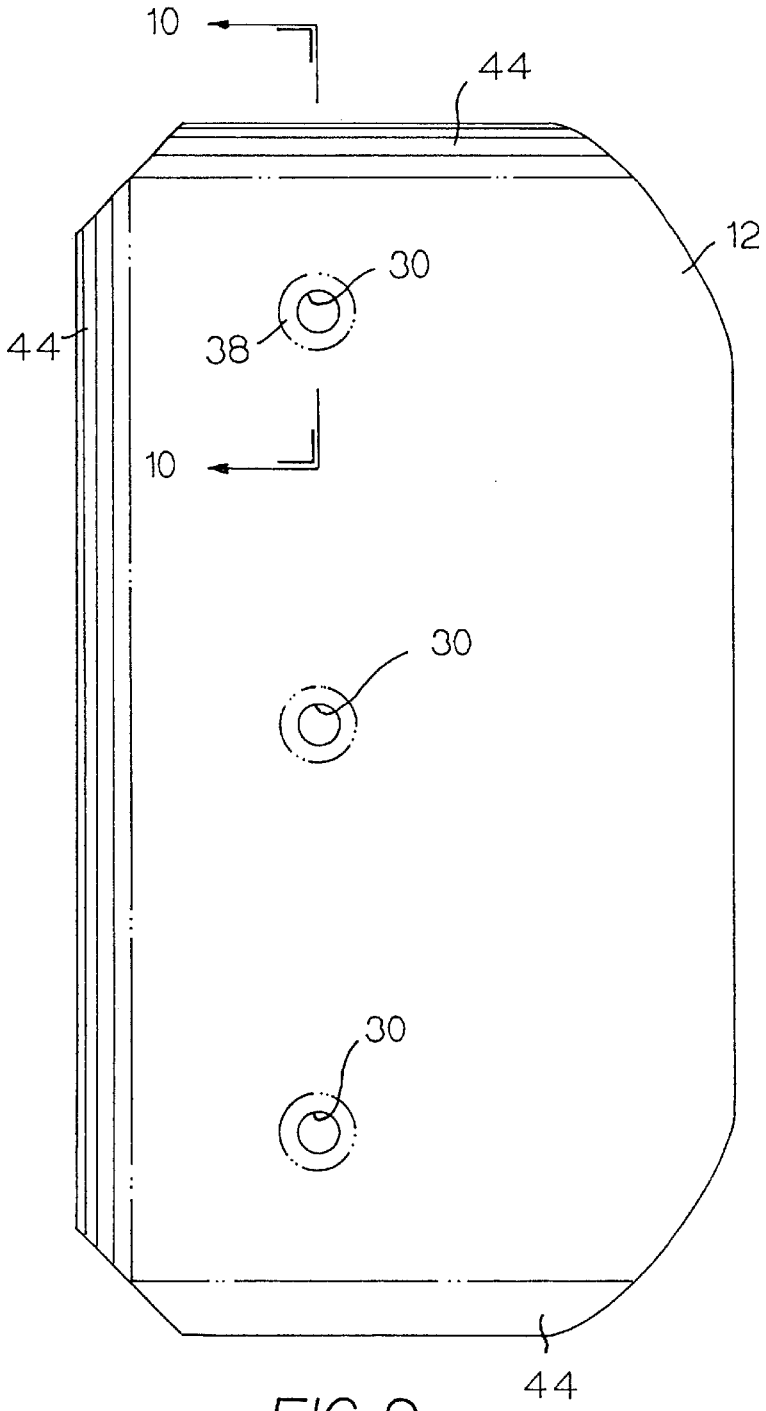
FIG. 9 is a top view of the blade of FIG. 1.
Figure 10:
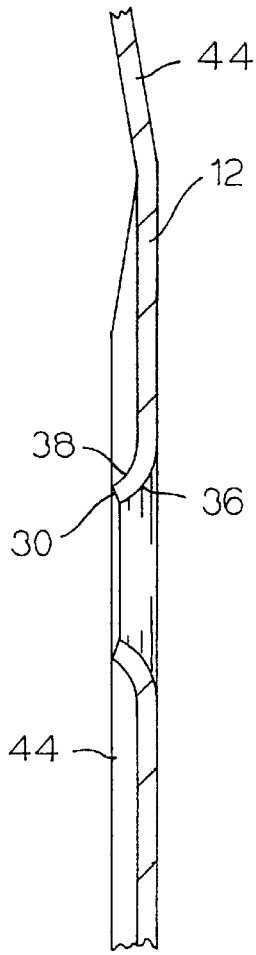
FIG. 10 is a view taken along the section 10—10 of FIG. 9.
Figure 11:
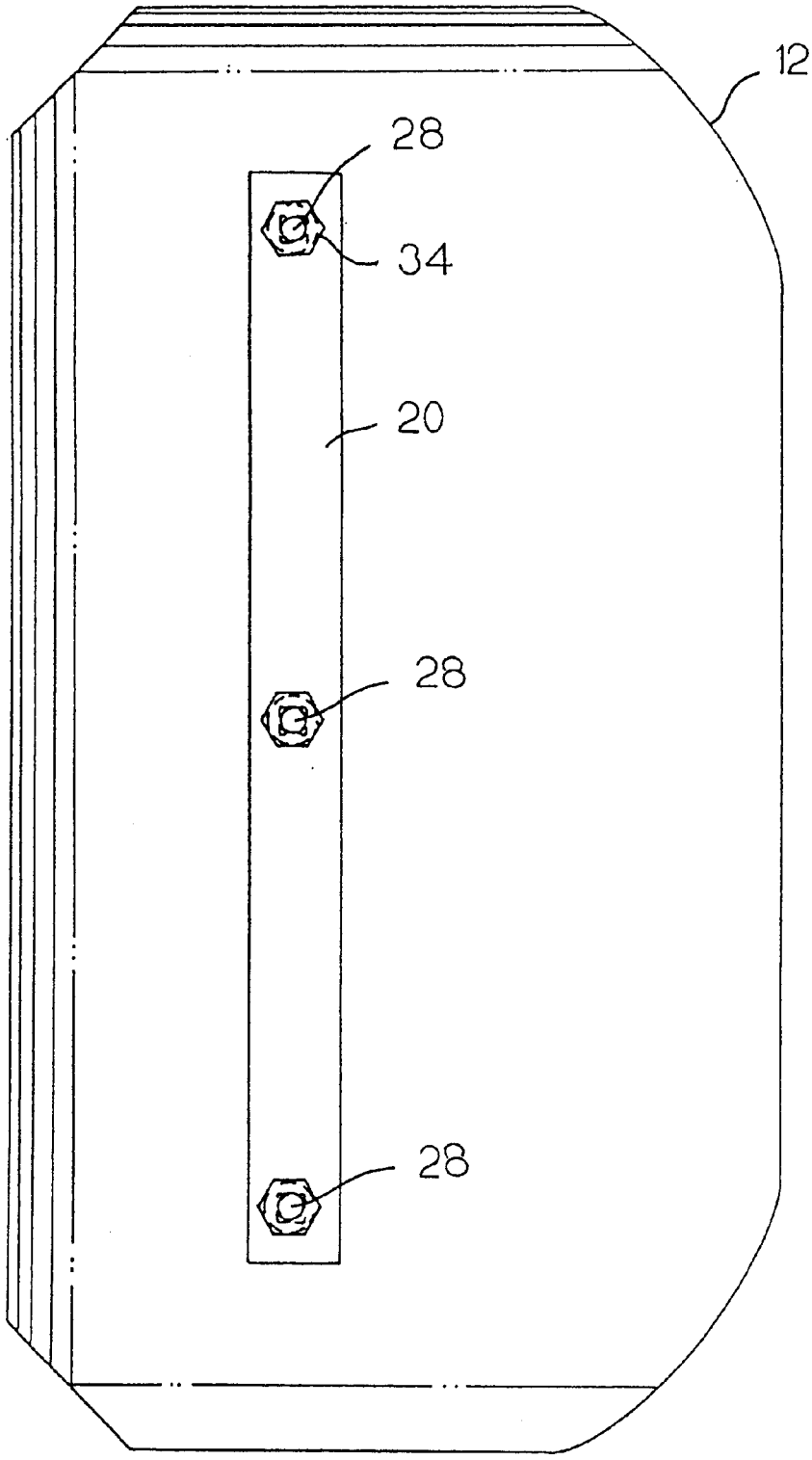
FIG. 11 is a top view of the backing bar and blade from the machine of FIG. 1, with the trowel arm removed for clarity.

In this preferred embodiment, the generally flat blade 12 is deformed upwardly in the area of the holes 30 to form tapered recesses 36 in its bottom surface and tapered projections 38 in its top surface around the holes 30. These projections and recesses are shown in more detail in FIG. 10. The blade 12 may also be deformed upwardly along its edges 44, as shown in FIGS. 9–11, and the outer contours of the blade may be made in any other desired configuration. The backing bar 20 has openings 40, and its bottom surface also defines a tapered recess 38A surrounding each opening 40. The countersunk portions or tapered recesses 38A in the bottom surface of the bar 20 receive the tapered projections 38 of the blade 12 with a snug, nested, interlocking fit. This provides a much larger surface area of contact between the bolt head 32 and the blade 12, provides clamping of the blade 12 to the countersunk surface 38A of the backing bar 20, provides a solid bolt head as opposed to a thin-walled rivet, and provides clamping contact between the bolt head 32, blade 12 and backing bar 20 in an area recessed from the normal flat portion of the blade so that, even as the blade wears and the flat surface of the bolt head wears, the blade 12 is securely fastened to the backing bar 20 and to the trowel arm 18. The outer surface of the head 32 preferably is flat, and the sides of the head 32 are tapered in a shape corresponding with the taper of the recesses 36.

The openings 40 in the backing bar 20 preferably are non-cylindrical, and the bolts 28 have a corresponding non-cylindrical neck portion 42 between the head 32 and the threaded end of the bolt to prevent the bolts 28 from rotating relative to the backing bar 20. In this embodiment, the openings 40 and the neck 42 have a square cross section, but they could have other non-cylindrical cross sections, such as hexagonal or defining some type of keyway.

FIGS. 9 and 10 show the trowel blade 12. This particular blade 12 has upwardly curved edges 44. In this embodiment, the projections 38 on the upper surface of the blade 12 extend approximately to the same height as the upwardly-curved edges 44. In the embodiment of FIG. 9, it can be seen that the holes 30 are in line and are spaced along the elongated direction of the blade 12. These holes 30 are positioned so they will be aligned with the trowel arm 18 of the machine on which the trowel blade 12 is to be mounted.

FIG. 11 shows a top view of the installed blade 12, with the trowel arm 18 removed to reveal the backing bar 20. This view shows the nuts 34, which are located above the trowel arm 18 when the blade 12 is assembled onto the machine.

Figure 12:
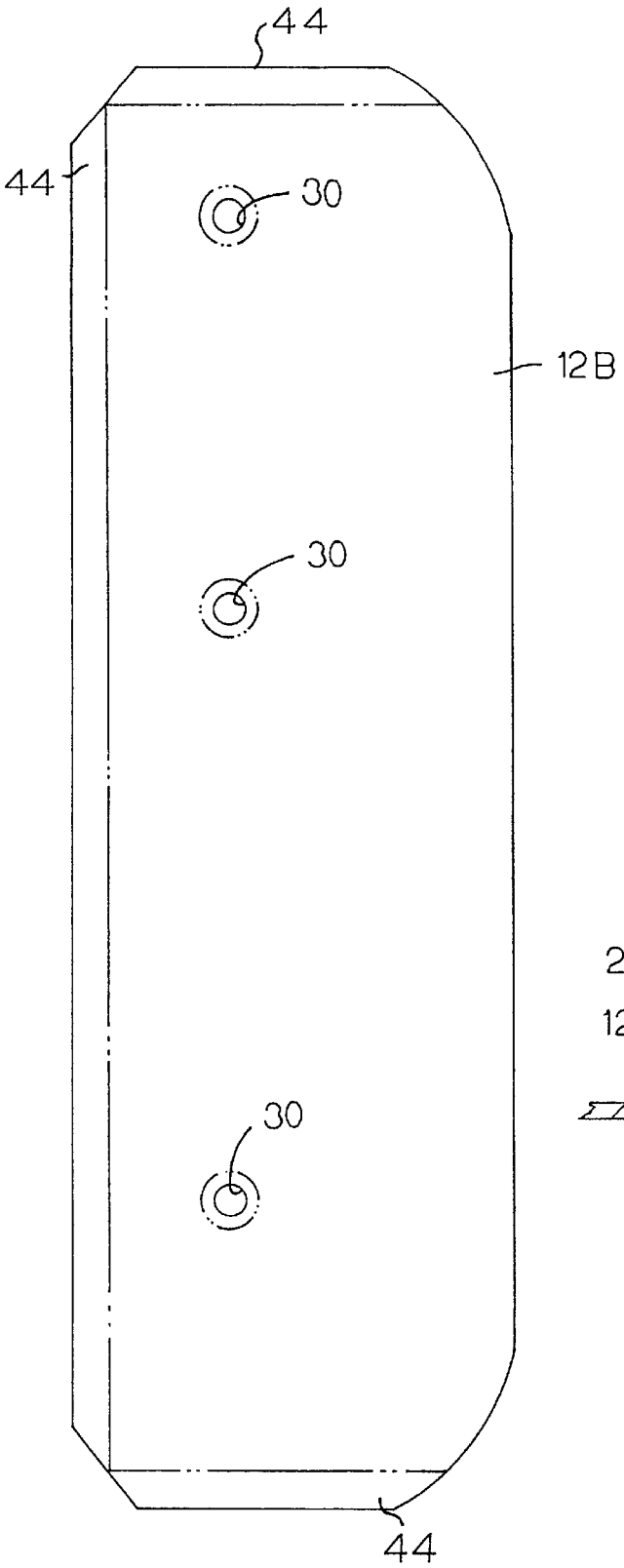
FIG. 12 is a top view of an alternative trowel blade made in accordance with the present invention.

FIG. 12 shows a top view of another embodiment of a blade 12B made in accordance with the present invention. This trowel blade 12B has a different length and shape from the first blade 12, which makes it suitable for mounting on a different type of trowel arm 18, and the in-line holes 30 are spaced differently along the elongated direction of the blade 12B. Again, these holes 30 are located in order to be aligned with the corresponding backing bar and trowel arm.

Figure 13:
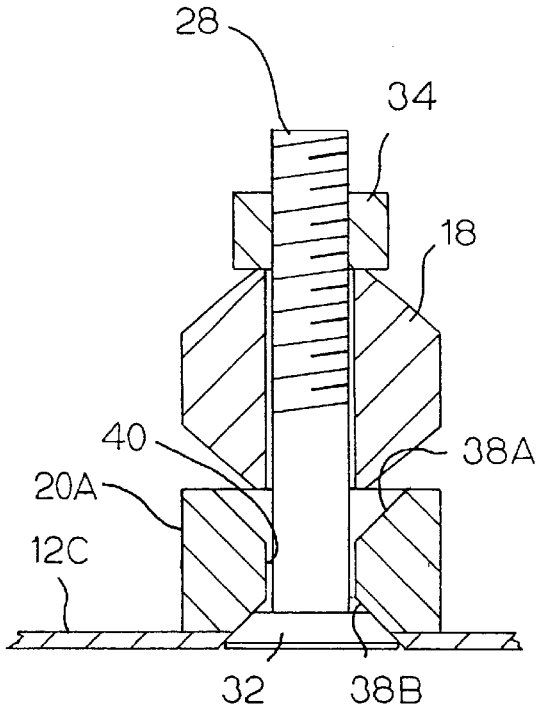
FIG. 13 is a sectional view of another mounting arrangement made in accordance with the present invention.

FIG. 13 shows an alternative mounting arrangement for mounting a finishing blade 12C. In this arrangement, the backing bar 20A has a larger diameter recess 38A surrounding the hole 40 on one surface and a smaller diameter recess 38B surrounding the hole 40 on the opposite surface. The first recess 38A is identical to the recess 38A described with respect to FIGS. 5–8. The second recess 38B is large enough to accommodate a portion of the solid head 32 of the bolt 28, but it is not large enough to receive the projection 38 from the trowel blade 12. The reason for the difference in the second recess 38B is that this side of the backing bar 20A is intended to receive a flat finishing blade 12C, which does not have projections in its top surface. While this mounting arrangement does not have all the advantages of the arrangement of FIGS. 5–8, it does provide a solid surface to receive the tapered bolt head 32 and the flat top surface of the blade 12C, which is far superior to the prior art arrangement of FIGS. 3 and 4, which left an air gap above the rivet and flat blade. Also, the use of a solid-headed bolt is superior to the use of a thin-walled rivet. So, the backing bar 20A of FIG. 13 can be used to mount two types of blades. It can be used as shown in FIG. 13 to mount a flat blade that does not have projections on its top surface surrounding the holes, and it can be inverted and used to mount a blade with projections as shown in FIGS. 5–8.

In these preferred embodiments, when the fasteners 28 are removed in order to remove the blade 12 from the trowel arm 18 so the blade can be replaced, the blade 12 also becomes separated from the backing bar 20. Thus, in this arrangement, only the blade 12 needs to be replaced —not the blade 12 and backing bar 20 combination as was required in the prior art. This saves substantial money and material over the design shown in FIGS. 3 and 4 in which, in order to replace the blade 12A, its associate backing bar 20A must also be replaced.

Figure 14:
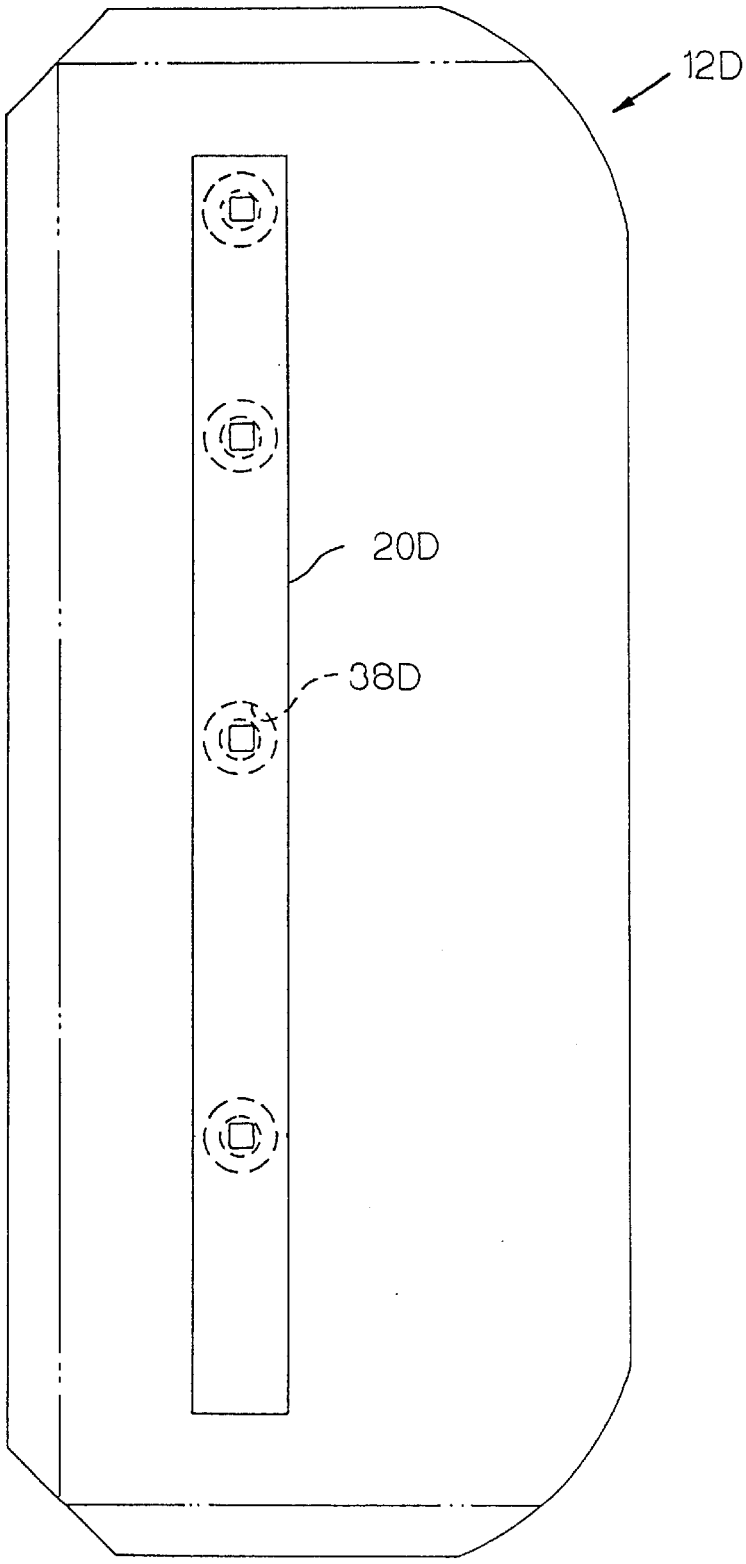
FIG. 14 is a view similar to FIG. 11 but showing an alternative embodiment in which the blade has non-circular cross-section holes.
Figure 14A:
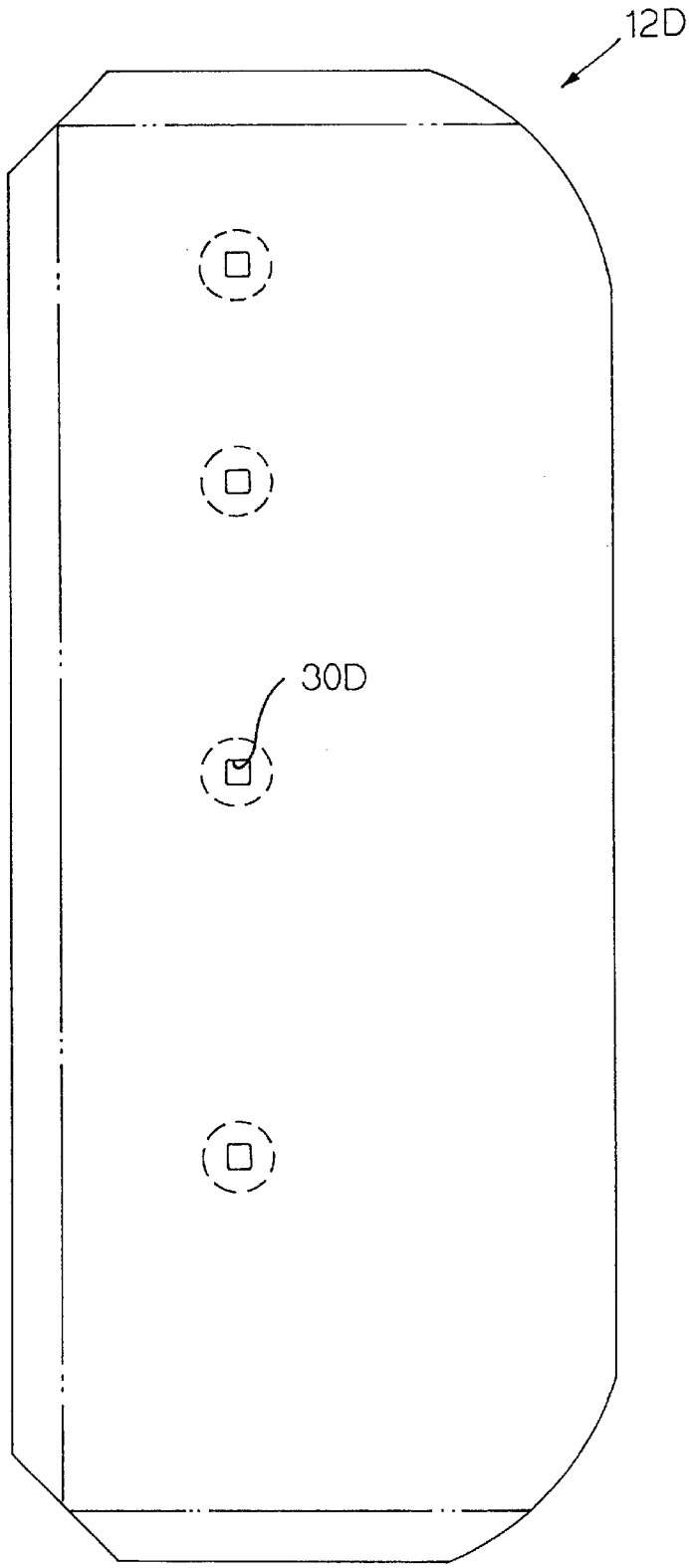
FIG. 14A is a plan view of the blade of FIG. 11 with the backing bar removed.
Figure 18:
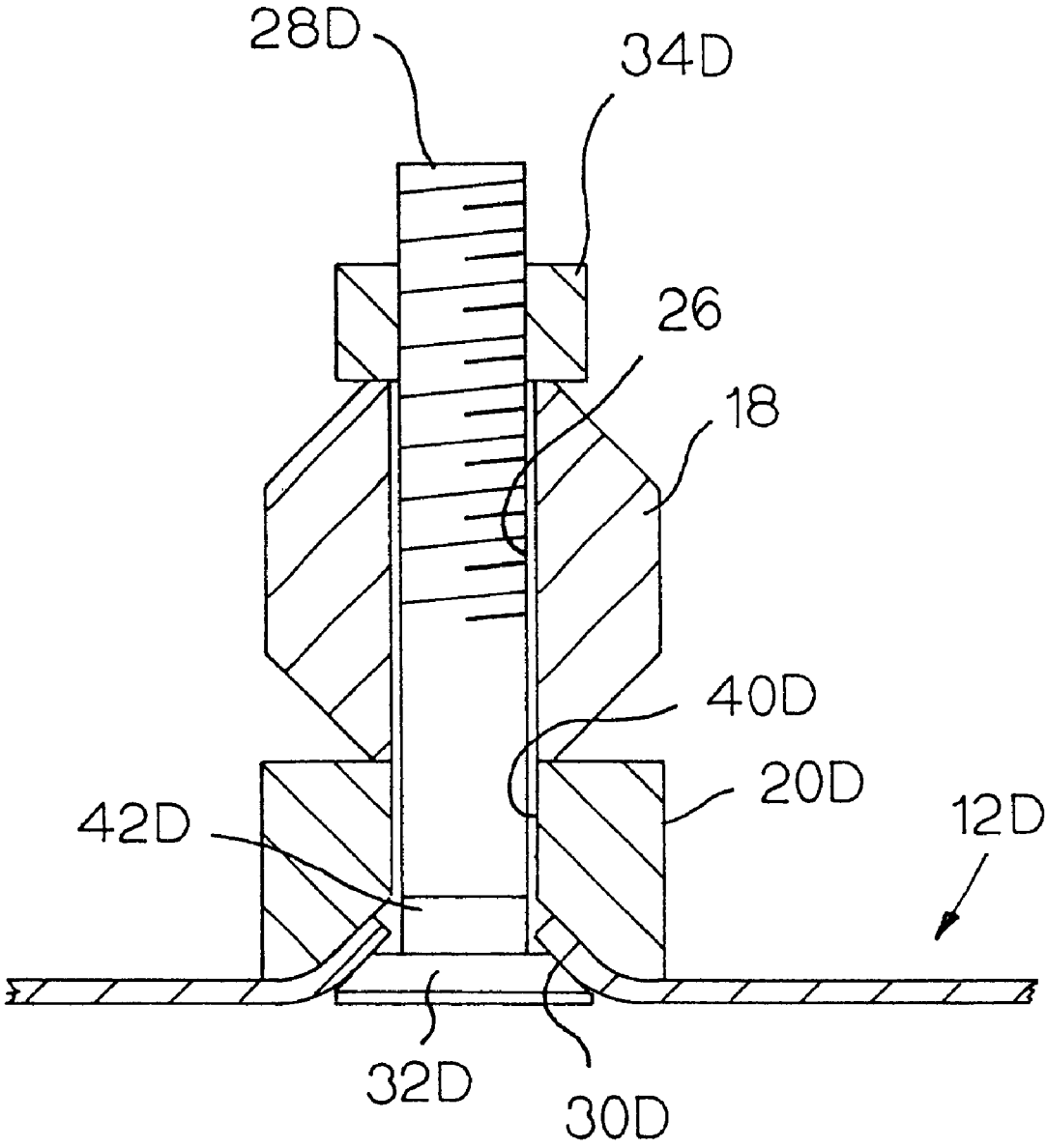
FIG. 18 is a sectional view through the blade of FIG. 14 mounted on a trowel arm.

FIGS. 14–18 show an alternative embodiment, which is very similar to the first embodiment, except that the non-circular cross-section hole which prevents the bolt from spinning is in the blade itself, rather than being in the backing bar. As shown in FIG. 14, the blade 12D has a backing bar 20D mounted on its upper surface. As shown in FIGS. 14A and 17, the holes 30D in the blade 12D have a non-circular (in this case substantially square) cross-section, and the blade 12D is deformed upwardly around the holes 30D in the area 38D. As shown in FIGS. 15 and 16, the backing bar 15 has a number of holes 40D, and the bottom surface of the backing bar 15 defines a recess around each of the holes 40D to receive the upwardly-deformed portions 38D of the blade. As shown in FIG. 18, the bolt 28D has a neck portion 42D that has a noncircular cross-section. This neck portion 42D substantially matches the size and shape of the non-circular hole 30D in the blade, so the non-circular cross-section opening 30D of the blade 12D prevents the bolt 28D from rotating relative to the blade. The remainder of the bolt 28D in this embodiment has a circular cross-section. The bolt 28D then extends through the circular hole 40D in the backing bar and through the hole 26 in the trowel arm 18 and is fastened on the other side by a nylon insert locknut 34D.

While the foregoing description has shown a few embodiments made in accordance with the present invention, those embodiments are intended for illustration purposes only and are not intended to restrict the scope of the claims. It will be obvious to those skilled in the art that modifications may be made to the embodiments described above without departing from the scope of the present invention. For example, while bolts are preferred, other known fasteners may be used instead. While one embodiment may show a non-circular cross-section hole in the blade, and another may show a non-circular cross-section hole in the backing bar, there could be a noncircular cross-section hole in both the blade and backing bar or in neither. Also, for example, while these embodiments show a separate backing bar 20, the trowel arm 18 itself could be designed to serve as the backing bar, eliminating the need for a separate backing bar. Many other embodiments would also be obvious to a person skilled in the art upon reading this disclosure.

What is claimed is:

1. A blade for a motorized trowel, comprising:

a substantially flat sheet of material forming an elongated blade, having a top surface and a bottom surface and defining a plurality of in-line holes spaced at intervals along the length of the blade; wherein the sheet is deformed upwardly surrounding the holes to form a tapered depression in the bottom surface surrounding the holes and a tapered projection in the top surface surrounding the holes; and a backing bar having a substantially flat bottom surface and defining a plurality of corresponding openings aligned with the holes in said blade, said openings being sized to receive the projections on the top surface of the blade;

wherein the holes of said blade have a non-circular cross-sectional shape.

2. A blade for a motorized trowel, comprising:

a substantially flat sheet of material forming an elongated blade, having a top surface and a bottom surface and defining a plurality of in-line holes spaced at intervals along the length of the blade; wherein the sheet is deformed upwardly surrounding the holes to form a tapered depression in the bottom surface surrounding the holes and a tapered projection in the top surface surrounding the holes; and a backing bar having a substantially flat bottom surface and defining a plurality of corresponding openings aligned with the holes in said blade, said openings being sized to receive the projections on the top surface of the blade;

wherein the openings of said backing bar have a non-circular cross-sectional shape.

3. A blade for a motorized trowel, comprising:

a substantially flat sheet of material forming an elongated blade, having a top surface and a bottom surface and defining a plurality of in-line holes spaced at intervals along the length of the blade; wherein the sheet is deformed upwardly surrounding the holes to form a tapered depression in the bottom surface surrounding the holes and a tapered protection in the top surface surrounding the holes and wherein the holes in said blade are non-circular, a backing bar having a substantially flat bottom surface and defining a plurality of corresponding openings aligned with the holes in said blade, said openings being sized and shaped to receive the projections on the top surface of the blade with a snug fit; and a plurality of fasteners extending through the holes in the blade into the openings in the backing bar, each of said fasteners having a head, extending up into the respective tapered depression of the blade and clamping the tapered projection of the blade against the backing bar; and each of said fasteners having a non-cylindrical shaft portion extending through amd mating with the non-circular cross-sectional holes in the blade such that the shaft is prevented from rotating.

* * * * *